US005111623A

United States Patent [19]

Lehmann

[11] Patent Number: 5,111,623

[45] Date of Patent: May 12, 1992

[54] PROCESS AND APPARATUS FOR MACHINING THE INNER SURFACES OF HOLLOW BODIES

[75] Inventor: Peter Lehmann, Hilden, Fed. Rep. of Germany

[73] Assignee: Mannesmann Aktiengesellschaft, Düsseldorf, Fed. Rep. of Germany

[21] Appl. No.: 523,794

[22] Filed: May 15, 1990

[30] Foreign Application Priority Data

May 16, 1989 [DE] Fed. Rep. of Germany ..... 3916113

[51] Int. Cl.[5] ..... B24B 5/40

[52] U.S. Cl. ..... 51/165.93; 51/55; 51/126; 51/290

[58] Field of Search ..... 51/165.93, 290, 55, 51/241 B, 127, 170 T; 15/104.09, 104.05, 104.063

[56] References Cited

U.S. PATENT DOCUMENTS

| | | | |
|---|---|---|---|
| 1,503,497 | 8/1924 | Glancy | 51/55 |
| 3,903,658 | 9/1975 | Daiuta | 51/55 |
| 4,229,908 | 10/1980 | Panzeri | 51/165.93 |

FOREIGN PATENT DOCUMENTS

| | | | |
|---|---|---|---|
| 0060417 | 4/1985 | U.S.S.R. | 15/104.09 |
| 1155362 | 5/1985 | U.S.S.R. | 51/170 T |
| 1172682 | 8/1985 | U.S.S.R. | 51/170 T |
| 1227267 | 4/1986 | U.S.S.R. | 15/104.05 |

*Primary Examiner*—Robert A. Rose
*Attorney, Agent, or Firm*—Nils H. Ljungman & Associates

[57] ABSTRACT

A process and apparatus for machining the inner surface of a pipe where a tool carrier is positioned adjacent the area to be machined and a cutting tool is advanced about a pivot axis around the inner surface of the pipe, while also having a pendulum movement of the tool holder in a direction parallel to the pivot axis. The pendulum axis is perpendicular to the pivot axis, while the pivot axis is parallel to the axis of the pipe. The apparatus has a transporter to move it into location and motor drives to pivot a tool holder and provide the pendulum movement. A distance sensor and adjustment apparatus maintains a supporting member carrying the tool holder at a desired radial position relative to the inner surface of the pipe.

13 Claims, 1 Drawing Sheet

PROCESS AND APPARATUS FOR MACHINING THE INNER SURFACES OF HOLLOW BODIES

BACKGROUND OF THE INVENTION

1. Field of the Invention

This invention relates to a process for machining the inner surfaces of hollow bodies, such as pipes, and to an apparatus for the performance of this process.

2. Background of the Invention

German Patent No. DE 34 46 055 Al, the contents of which are incorporated by reference herein, discloses a process and an apparatus for machining the inner surfaces of tubes, by means of which the root layers of circumferential weld seams can be machined on pipelines which have already been laid. The apparatus disclosed therein has a transporter consisting of wheels which are distributed over the inside circumference of the tube and off-set from one another by 120 degrees. These wheels can be adjusted hydraulically or pneumatically in the radial direction in relation to the inner surface of the tube, and make it possible to center the apparatus in relation to the tube axis. On the outside of the apparatus, there are several motor-driven grinding devices which can be adjusted radially outward, with radially oriented axes of rotation and pot-shaped abrasive wheels. For example, to produce thrust in the circumferential direction of the tube for working weld seams, there are special drive wheels which are in contact with the inner surface of the tube and which set the entire apparatus in rotation. The axis of rotation of the transporter wheels, which also make possible movement in the direction of the tube axis, is pivoted by 90 degrees, so that they can run in the circumferential direction.

A disadvantage of this apparatus of the prior art is the fact that working in the plane of the sheet metal, e.g., of the root layers of circumferential weld seams is hardly possible. At all times, this requires an exact adjustment of the grinding wheels in relation to the inner surface of the tube. If the adjustment of the grinding wheels is not close enough, a portion of the material to be removed remains in place. Alternatively, if the radial adjustment puts the grinding wheels too far outward, a groove-shaped recess is formed on the inner surface of the tube, which produces an undesirable notch effect, and also has a deleterious effect on the flow characteristics of the pipeline. Variations in the cross-sectional geometry of the tube from the ideal circular shape also lead to corresponding locally deficient or excessive removal of material.

OBJECT OF THE INVENTION

The object of the invention is, therefore, to significantly improve the process of the prior art, to eliminate the disadvantages described above, and to provide an apparatus for the performance of this process.

SUMMARY OF THE INVENTION

A process and apparatus for machining the inner surface of a tubular member, such as a pipe, uses a tool holder that pivotally rotates about an axis and also moves with a pendulum motion in a direction parallel to the pivot axis.

According to the process, a tool carrier is positioned adjacent the area to be machined and a cutting tool is advanced about an axis of rotation, or pivot axis, around the inner surface of the tubular member, while the cutting tool is moved with a pendulum motion, along a pendulum axis, in a direction parallel to the axis of rotation. The vertical distance between the pendulum axis and the inner surface, during operation of the cutting tool, is kept constant by scanning the inner surface and adjusting the distance therebetween.

The apparatus for carrying out the process includes a tool carrier and an apparatus for moving the tool carrier, such as a motor driven transporter, in the direction of the axis of the tubular member to the desired machining location, such as a weld. A remotely controlled clamping apparatus is provided that fixes the tool carrier rigidly in position adjacent the area to be machined. A supporting member carrying a tool holder is secured to a pivot drive carried by the tool carrier, the pivot drive having a pivot axis parallel to the axis of the tubular member. A cutting tool is provided on the tool holder. The tool holder is advanced about the inner surface of the tubular member by a motor drive, while the tool holder also has a drive to move the tool holder in a pendulum movement about a pendulum axis that is perpendicular to the pivot axis of the pivot drive.

A remote control is used to adjust the radial positioning of the tool holder relative to the inner surface of the tubular member, and a distance sensor, such as a measuring pin, is provided on a supporting member for the tool holder that communicates with the control for the adjustment apparatus. The adjustment apparatus is preferably a pneumatic double piston system. The distance sensor is preferably a measuring pin with a wheel or spherical head that contacts the inner surface of the tubular member.

One aspect of the invention resides broadly in a process for machining an area of the inner surface of a tubular member having an axis, comprising: positioning a tool carrier adjacent the area of the tubular member to be machined; advancing a cutting tool, about an axis of rotation, around the inner surface of the tubular member at the area to be machined; moving the cutting tool with a pendulum motion, along a pendulum axis, in a direction parallel to the axis of rotation the cutting tool.

Another aspect of the invention resides broadly in an apparatus for machining an area of the inner surface of a tubular member comprising: a tool carrier; means for moving the tool carrier in the direction of the axis of a tubular member to a location adjacent the area to be machined; a remotely controlled clamping apparatus for rigidly fixing the tool carrier in the tubular member at a location adjacent the area to be machined; a pivot drive carried by the tool carrier having a pivot axis parallel to the axis of the tubular member; a supporting member secured to the pivot drive on the tool carrier; at least one tool holder fastened to the supporting member, the tool holder advanced about the inner surface of the tubular member by the pivot drive; a cutting tool on the tool holder; and means for providing a pendulum movement of the tool holder about a pendulum axis perpendicular to the pivot axis of the pivot drive.

BRIEF DESCRIPTION OF THE DRAWINGS

The invention is explained in further detail below and with reference to the schematic illustrations in the accompanying FIGS. 1 to 3, in which.

DESCRIPTION OF THE PREFERRED EMBODIMENT

Figure 1:
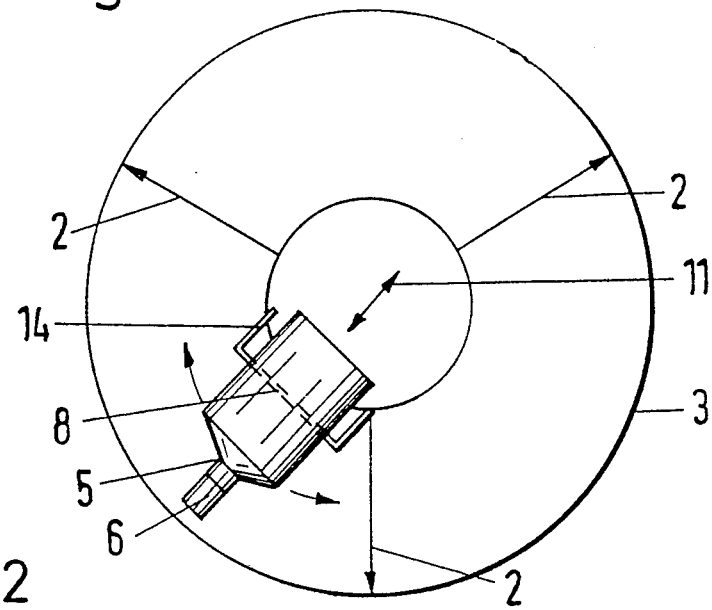
FIG. 1 is a schematic axial cross-section through an apparatus disposed in a pipeline according to the invention.

The apparatus according to the invention has a tool carrier 1, such as a pipeline pig, which is equipped with transporters 13, so that it can travel through a tubular member such as a pipeline 3 in the axial direction to a point where the machining is to take place (e.g. a circumferential weld seam or welded-in supports). Arrival at the point where the machining is to take place can be monitored externally, such as by means of a video camera (not shown), or by means of a radioactive position indicator. By means of a clamping apparatus, which preferably consists of three hydraulically or pneumatically operated pressure rams 2, offset from one another by 120 degrees and adjustable radially outward, the tool carrier 1 can be rigidly fixed in the tube 3. At the same time, the tool carrier 1 can be more or less centered in relation to the axis of the tube, although this centering is not a prerequisite for a satisfactory operation of the apparatus according to the invention. All that needs to be guaranteed is that the pivot axis 7 of a pivoting drive 4 is sufficiently parallel to the axis of the tube. When the tool carrier 1 is standing still and fixed in the tube adjacent the area to be machined, the pivoting drive 4 produces the thrust motion or advancement of the cutting tool 6, which can be either a grinding wheel or a milling cutter, in the form of a rotation movement about the inner surface of the tube. A supporting member 14 is rigidly fastened to the rotating portion of the pivoting drive 4. On the suspension, or supporting member 14, there is mounted a tool holder 5 having a drive motor, mounted so that the tool holder can rotate with, or swing about, the pendulum axis 8. The pendulum axis 8 is perpendicular to the pivoting axis 7 and also to the axis of the tube.

By means of the schematically illustrated pendulum drive 9, the tool holder 5 and, thus, the machining tool 6 secured therein can execute oscillating circular or pendulum movements around the pendulum axis 8. These oscillating pendulum movements are therefore transverse to the direction of advance of the tool holder (that is, to the direction of rotation around the pivot axis 7) and to the cutting tool 6. An example may be, in the case of machining, a circumferential weld seam 12, transverse to the direction of the seam, as illustrated by the arrows in FIG. 3. To change the cutting depth of the cutting tool 6, there is a radial adjustment apparatus 11 (shown schematically in FIG. 1), which can be adjusted by remote control and which is preferably designed as a pneumatic or hydraulic double piston system. The axis of rotation of the cutting tool is preferably always coaxial with the radial adjustment apparatus. A distance sensor 10, which communicates with the radial adjustment apparatus, and which is preferably designed as a measuring pin with a wheel or spherical head, is connected to the supporting member 14 and therefore accompanies, or moves along with, each pivoting movement of the tool holder 5. The sensor is elastically braced or biased, such as by the force of a spring, against the inside surface of the tube 3. When there is movement of the measuring pin 10 in either direction relative to a defined zero position, e.g. by closing electrical contacts or by the direct activation of hydraulic or pneumatic valves, the radial adjustment apparatus 11 causes the tool holder 5, with the cutting tool 6, to move in or out in the radial direction, until the zero position is reestablished. It is thereby possible to guarantee that the pivoting axis 7 always maintains a uniform vertical distance from the inner surface of the tube, i.e., so that the tool 6 with its working surface always remains adjusted exactly to the inner surface of the tube. The cutting tool 6 can, thus, also exactly follow the inner surface of the tube, if the tube geometry varies from the ideal circular shape (e.g. on account of flat spots in the tube). To adjust to different tube diameters in order to set the desired depth of machining, the measuring pin 10 is designed so that its length is adjustable (e.g. as a headstock spindle).

An important characteristic of the invention is the pendulum drive for the tool holder 5, which produces an oscillating movement of the cutting tool 6, e.g. during the advancement along a circumferential weld. The working surface of the cutting tool 6 thereby constantly approximates an orbit which includes the surface of the tube 3, "dips" into it, in a manner of speaking, and moves away from it again. In this manner, there is always a smooth transition between the unworked inner surface of the tube and the machined area, even if the cutting tool 6 may have been set too deeply into the inner surface of the tube. Even in such cases, for example, it is possible to practically guarantee a plane machining of weld seams.

However, not only can the apparatus according to the invention be used in the manner described above to machine root layers on circumferential weld seams, but it is also suited for other types of machining tasks in pipelines and vessels. For example, the pendulum drive 9 can also be fixed in a desired angular position, so that with an approximately inclined milling cutter it can be used to machine an inclined surface.

Figure 2:
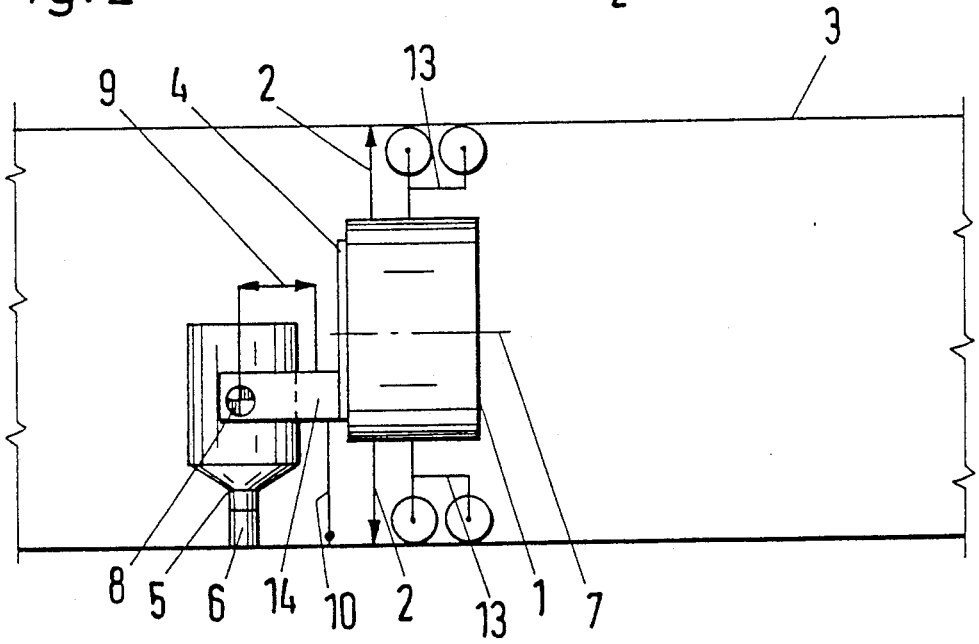
FIG. 2 is a schematic axial longitudinal section through the pipeline illustrated in FIG. 1.
Figure 3:
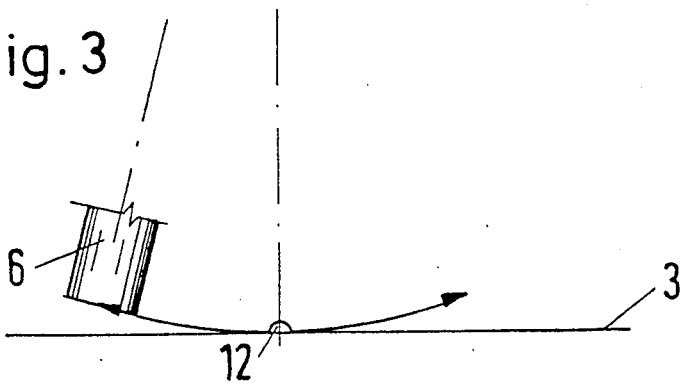
FIG. 3 is a schematic axial longitudinal section in the vicinity of a circumferential weld seam.

Numerous adaptions of the invention illustrated in FIGS. 1 through 3 are possible. For example, instead of one tool holder 5, there can be a plurality of tool holders on the pivoting device 4, each having adjustment and pendulum devices independent of one another. To determine the distance between the inner surface of the tube and the pivot axis 7, sensors can be used which operate according to different physical principles (e.g. laser optics, ultrasound, capacitive or inductive displacement transducers, etc.) The clamping apparatus can also be activated electrically, magnetically or mechanically.

In addition to pneumatic and hydraulic drives, electrical drives in particular can be considered for the various drives. For the movement of the apparatus in a pipeline, in addition to the transporter 13 having its own drive mechanism, the transporter can also be suspended from a self-propelled inspection apparatus, or the transporter can be propelled by means of sliding rods. In these cases, instead of a transporter, skids can also be used. Other configurations are also possible.

The process according to the invention can be performed in an altogether .advantageous manner if the apparatus described in the embodiment is operated and controlled largely automatically by computer, whereby the individual drives can be optimally coordinated with one another.

The operation of the apparatus may be computer controlled, by a computer C , such that, as a function of the material from which the tubular member is made, and of the geometry and type of cutting tool used, the adjustment angle and pendulum or oscillating frequency and amplitude, as well as the drive speed of the cutting tool, speed of advancement around the inside surface, and radial adjustment of the position of the cutting tool holder and of tool and the depth of machining, can be controlled within specified tolerances and settings.

All, or substantially all, of the components and methods of the various embodiments may be used with at least one embodiment or all of the embodiments, if any, described herein.

All of the patents, patent applications and publications recited herein are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An apparatus for machining an area of the inner surface of a tubular member having an axis, said apparatus comprising:

a tool carrier;

means for moving said tool carrier in the direction of the axis of the tubular member to a location adjacent the area to be machined;

a remotely controlled clamping apparatus for rigidly fixing said tool carrier in the tubular member at the location adjacent the area to be machined;

a pivot drive carried by said tool carrier, said pivot drive having a pivot axis parallel to the axis of the tubular member;

a supporting member secured to said pivot drive on said tool carrier;

at least one tool holder fastened to said supporting member, said tool holder for being advanced about the inner surface of the tubular member by said pivot drive;

a cutting tool movably positioned on said tool holder; and means for providing a pendulum movement of said tool holder about a pendulum axis that is perpendicular to the pivot axis of said pivot drive.

2. The apparatus for machining an area of the inner surface of a tubular member having an axis as defined in claim 1, further comprising a remotely controlled means for adjusting the radial position of said tool holder relative to the inner surface of the tubular member.

3. The apparatus for machining an area of the inner surface of a tubular member having an axis as defined in claim 2, further comprising a distance sensor on said supporting member, said distance sensor for monitoring the distance between said supporting member and the inner surface of the tubular member, said sensor for communicationg with said means for adjusting said radial position of said tool holder to adjust the same.

4. The apparatus for machining an area of the inner surface of a tubular member having an axis as defined in claim 2, wherein said means for adjusting said radial position of said tool holder comprises a pneumatic double piston system.

5. The apparatus for machining an area of the inner surface of a tubular member having an axis as defined in claim 3, wherein said distance sensor comprises a measuring pin.

6. An apparatus for machining an area of the inner surface of a tubular member having an axis as defined in claim 5, wherein said measuring pin comprises at least one of a wheel and a spherical head said at least one of a wheel and a spherical head for contacting the inner surface of the tubular member.

7. The apparatus for machining an area of the inner surface, of a tubular member having an axis as defined in claim 5, wherein said distance sensor is adjustable in length by remote control.

8. The apparatus for machining an area of the inner surface of a tubular member having an axis as defined in claim 7, wherein said distance sensor is an adjustable headstock spindle.

9. The apparatus for machining an area of the inner surface of a tubular member having an axis as defined in claim 1, wherein said means for moving said tool carrier comprises a motor driven transporter.

10. The apparatus for machining an area of the inner surface of a tubular member as defined in claim 2, wherein said axis of rotation of the cutting tool is coaxial to said radial adjustment apparatus.

11. The apparatus for machining an area of the inner surface of a tubular member as defined in claim 2, further including a computer to control the pendulum motion frequency and amplitude, the drive speed of the cutting tool, advancement of the tool holder and adjustment of the radial position of the tool holder and cutting tool.

12. An apparatus for machining an area of the inner surface of a tubular member as defined in claim 1, wherein said tool carrier comprises a pipeline pig.

13. A process for machining an area of the inner surface of a tubular member with a cutting tool mounted on a movable tool carrier, said process comprising the steps of:

movably attaching said cutting tool to said tool carrier;

positioning said tool carrier within the tubular member;

advancing said tool carrier axially within the tubular member to the area of the inner surface of the tubular member to be machined;

advancing said cutting tool about an axis of rotation and around the inner surface of the tubular member at the area to be machined;

moving the cutting tool with a pendulum motion in a direction parallel to the axis of rotation of the cutting tool, said pendulum motion occurring along a pendulum axis, the pendulum axis being substantially perpendicular to the axis of rotation and located a distance away from the inner surface of the tubular member; and maintaining the distance between the pendulum axis and the inner surface of the tubular member constant during advancement of said cutting tool about the axis of rotation and around the inner surface of the tubular member by:

scanning the distance between the pendulum axis and the inner surface of the tubular member with sensor means; and automatically adjusting the distance between the pendulum axis and the inner surface of the tubular member with radial adjustment means.

* * * * *